US006402450B1

(12) United States Patent
Kritzinger

(10) Patent No.: US 6,402,450 B1
(45) **Date of Patent: *Jun. 11, 2002**

(54) BOOK BINDING

(76) Inventor: Ann C. Kritzinger, 20 Shepherds Hill, London N6 5AH (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/230,197

(22) PCT Filed: Jun. 23, 1997

(86) PCT No.: PCT/GB97/01678

§ 371 (c)(1),
(2), (4) Date: Jan. 20, 1999

(87) PCT Pub. No.: WO97/49563

PCT Pub. Date: Dec. 31, 1997

(30) Foreign Application Priority Data

Jun. 26, 1996 (GB) ..... 9613339

(51) Int. Cl.[7] ..... B42C 11/00

(52) U.S. Cl. ..... 412/4; 270/4; 270/58.07; 412/2; 412/8; 412/900

(58) Field of Search ..... 412/8, 6, 1, 28–32, 412/37, 900, 901, 2; 270/4, 58.07, 58.08

(56) References Cited

U.S. PATENT DOCUMENTS

| | | | | | |
|---|---|---|---|---|---|
| 373,791 | A | * | 11/1887 | Worthington | 412/1 |
| 2,185,721 | A | * | 1/1940 | Brisendine | 281/21.1 |
| 3,114,543 | A | * | 12/1963 | Bishop et al. | |
| 3,404,880 | A | * | 10/1968 | Porter et al. | |
| 3,693,486 | A | * | 9/1972 | Maniaci et al. | 83/88 |
| 3,718,939 | A | * | 3/1973 | Mebus | 412/1 |
| 3,811,998 | A | * | 5/1974 | James | 281/21.1 |
| 3,841,182 | A | * | 10/1974 | Cosgrove et al. | 83/89 |
| 4,155,133 | A | | 5/1979 | Timson | |
| 4,511,297 | A | * | 4/1985 | Wilson et al. | 412/8 |
| 4,606,689 | A | * | 8/1986 | Wiholm | 412/3 |
| 4,558,980 | A | * | 5/1992 | Sturdivan | 412/2 |
| 5,114,291 | A | * | 5/1992 | Hefty | 412/8 |
| 5,224,737 | A | * | 7/1993 | McCurdy et al. | 281/29 |
| 5,296,606 | A | * | 3/1994 | Dahlquist | 156/201 |
| 5,417,535 | A | * | 5/1995 | Andjelic et al. | 412/2 |
| 5,461,469 | A | * | 10/1995 | Farrell et al. | 355/321 |
| 5,509,987 | A | * | 4/1996 | Dahlquist | 156/201 |
| 5,531,429 | A | | 7/1996 | Clark | |
| 5,614,991 | A | * | 3/1997 | Moro et al. | 355/75 |
| 5,645,387 | A | * | 7/1997 | Scalet et al. | 412/1 |
| 5,875,705 | A | * | 1/1999 | Dahlquist | 281/5 |
| 5,961,268 | A | * | 10/1999 | Jager | 412/1 |
| 6,284,083 | B1 | * | 9/2001 | Dahlquist | 156/201 |

FOREIGN PATENT DOCUMENTS

| | | |
|---|---|---|
| DE | 817439 | 8/1951 |
| EP | 0 046 168 | 2/1982 |
| GB | 212393 | 4/1924 |

OTHER PUBLICATIONS

International Search Report for PCT/GB97/01678, 3 pages Sep. 10, 1997.

* cited by examiner

*Primary Examiner*—A. L. Wellington
*Assistant Examiner*—Monica Carter
(74) *Attorney, Agent, or Firm*—ipsolon LLP

(57) ABSTRACT

A method of binding books comprising the steps of holding in place a text hull (1) comprising the pages of two books (2, 3) the gutters (5, 19) of the two books being located on opposite edges of the text hull to one another, binding the opposite edges of the text hull adjacent the gutter of the pages; and dividing the text hull to separate the two books from one another.

5 Claims, 2 Drawing Sheets

BOOK BINDING

THE PRESENT INVENTION relates to a method of binding books and an apparatus for binding books.

At present book binding is often subcontracted from a printer to a book manufacturing plant. While the length of print runs has been reduced recently, there has been little or no development in the field of short-run, quality book binding. Traditional finishing systems in general, although highly automated in themselves, are usually quite time-consuming to set up and therefore do not lend themselves to short runs.

Traditionally books are printed on a number of large sheets, which have to be folded, collated and gathered for sewing, or cut into pages before paperback binding as is described in greater details below. Digital presses can print, collate and gather all the pages of a book in one operation. In many cases two (or even four) books can be printed at one time (two-to-view or duplex printing). This facility is wasted when these two (or four) copies have to be cut apart into single blocks of pages for machines that can bind only one copy at a time.

It is already known to provide automated machines for book binding assembly. Typically, such a machine takes a stack of printed pages, known as a text hull, and clamps them in place. Each stack of pages forms the pages of one completed book. The pages of two books printed two-to-view are traditionally printed so that the gutter of each page, that is to say the margin of the page that is closest to the spine in a completed book, forms a line along the centre of the text hull.

The next step for two books printed two-to-view is for the text hull to be separated into individual stacks of pages for a single book by cutting the text hull into sections. A cover is glued to the gutter edge of each of the pages in a section and folded around the pages of the book. Finally, the book is trimmed along the three other margins known as the head, foot, and fore-edge margins. This trimming stage ensures that the pages of the book are of exactly the same size as the portions of the cover at each end of the book so that the cover does not extend beyond the edges of the pages.

The problem with this type of process is that the covers of each of the books must be glued individually since the gluing stage is not carried out until the text hull has been separated into individual sections. Another problem with the existing process is that each of the four margins of a book must be trimmed which is time consuming.

The present invention seeks to provide an improved method of binding books and an improved book binding apparatus specifically for digital printing presses, copiers or the like.

According to one aspect of the present invention, there is provided a method of binding books comprising the steps of holding in place a text hull comprising the pages of at least two books, the gutters of said at least two books being located on opposite edges of the text hull to one another; binding the opposite edges of the text hull adjacent the gutter of the pages; and dividing the text hull to separate said at least two books from one another.

Conveniently, the binding step comprises the step of applying adhesive to the opposite edges of the text hull and pressing a binding strip against the opposite edges of the text hull.

Preferably, the binding step comprises the further step of jogging and/or milling said opposite edges of the text hull before applying adhesive to said opposite edges.

According to another aspect of the invention there is provided a book binding apparatus comprising securing means to hold a text hull in place, the text hull comprising the pages of at least two books, the gutters of said at least two books being located on opposite edges of the text hull; binding means to bind together each of the opposite edges of the text hull adjacent the gutter of the pages; and separating means to divide the text hull to separate said at least two books from one another.

Conveniently, said binding means comprises means to apply adhesive to said opposite edges of the text hull and means to press a binding strip to the opposite edges of the text hull adjacent the gutter of the pages.

Advantageously, said binding means is adapted to apply cold glue, hot glue, a wet glue or water to activate a wet glue.

According to a further aspect of the present invention there is provided a book comprising at least one page, said at least one page being enfolded by an end paper, the or each edge of said at least one page adjacent the gutter being attached to said end paper, said end paper being enfolded by a cover, the outer sides of the end paper being attached, in a region adjacent the gutter of the pages, to the inner surface of the cover such that a hollow is provided adjacent the gutter between the cover and the end paper.

Another aspect of the present invention provides a method of book binding comprising the steps of: providing a supply of pages having an inactive bonding agent on or in each page; printing onto a page from the supply; activating the bonding agent on the printed page; and stacking the printed pages with activated bonding agent onto one another to form a text hull.

A further aspect of the present invention provides a book comprising a cover enfolding at least two pages including a top page and a bottom page, the edges of the pages adjacent the gutter being attached to one another and the outer sides of the top and bottom pages being attached, in a region adjacent the gutter of the pages, to the inner surface of the cover such that a hollow is provided adjacent the gutter between the cover and the edges of the paper adjacent the gutter.

In order that the present invention may be more readily understood, and so that further features thereof may be appreciated, embodiments of the invention will now be described, by way of example, with reference to the accompanying drawings, in which.

Figure 1:
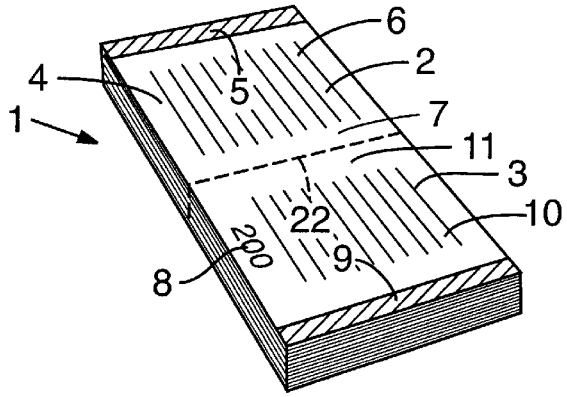
FIG. 1 is a perspective view of a text hull for use in a first stage of a method embodying the present invention.

Referring initially to FIG. 1 a text hull 1 is provided, the text hull 1 comprising a stack of sheets of paper printed from a printer or a copier or the like. Each sheet is made up of a page for a first book 2 and a page for a second book 3. Most conveniently, the sheets are produced by a digital printing press. The pages of the first book 2 have a foot margin 4 at the bottom of each page, a gutter 5 along the outer edge of each page (a gutter being the blank marginal part of the surface of each page between the text and the edge of the page as shown in cross hatching in FIG. 1), a head margin 6 at the top of each page and a fore-edge margin 7 along the edge of each page at the centre of the text hull 1. The second book 3 is substantially identical to the first book 2, having a foot margin 8, a gutter 9, a head margin 10, and a fore-edge margin 11. The pages of the first book 2 and the second book 3 are arranged in the text hull 1 so that the gutter 5 of the first book 2 and the gutter 9 of the second book 3 are at opposed ends of the text hull 1. This particular configuration requires that the first page of the first book 2 is at the top of the text hull whereas the first page of the second book 3 is at the bottom of the text hull 1. A book binder embodying the present invention includes securing means which hold the text hull 1 in this configuration. Such securing means are well known in the art.

Figure 2:
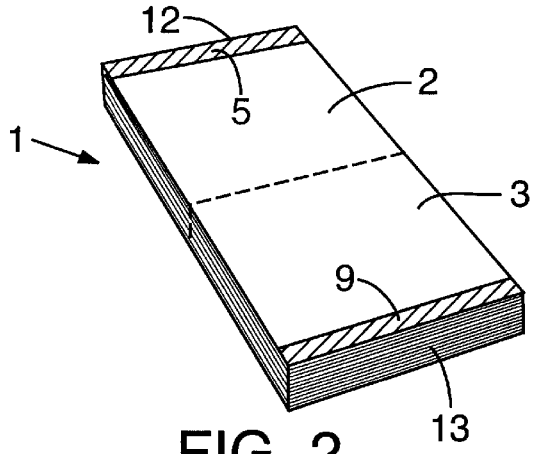
FIG. 2 is a perspective view of the text hull of FIG. 1 in a second stage of the method embodying the present invention.

Referring now to FIG. 2 of the accompanying drawings, the next step in the preparation of the text hull 1 is shown. The side of the text hull 1 defined by the edges 12 of the pages of the first book 2 adjacent the gutter 5 is machined by a jogging and/or a milling machine so as to prepare the side to receive a glue or bonding agent. Similarly, the side of the text hull defined by the edges 13 of the pages of the second book 3 adjacent the gutter 9 is also jogged and/or milled. In alternative embodiments of the present invention, the edges 12, 13 of the pages adjacent the gutter are prepared by means of ultrasonic vibration, air draught or friction feed.

Figure 3:
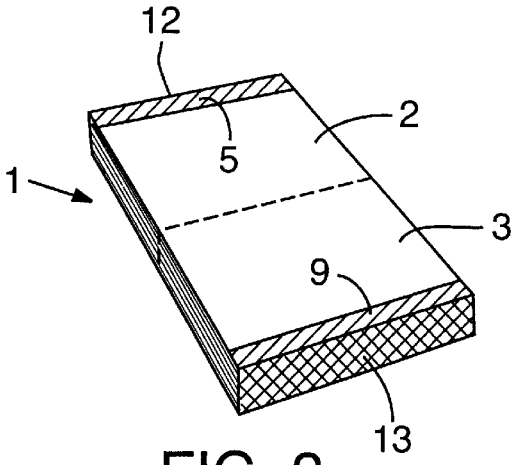
FIG. 3 is a perspective view of the text hull of FIG. 1 in a third stage of the method embodying the present invention.

Referring to FIG. 3 of the accompanying drawings, the next stage in the manufacture of the books 2, 3 is shown. Adhesive is applied to the page edges 12, 13 adjacent to the gutters, 5, 9 respectively. In the preferred embodiment of the present invention the adhesive is a cold glue but in alternative embodiments the glue may be a hot glue, a strip glue, or a wet or self-adhesive glue applied within or on the paper itself. Further details of embodiments in which the bonding agent has been pre-applied to the paper are discussed below.

Figure 4:
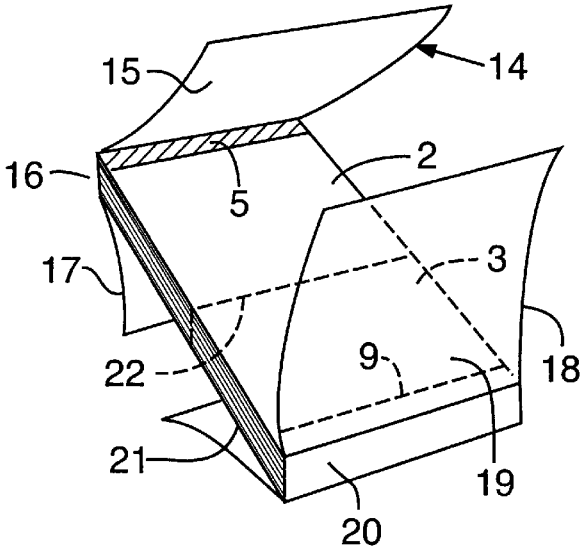
FIG. 4 is a perspective view of the text hull of FIG. 1 provided with covers for use in a fourth stage of the method embodying the present invention.

Referring to FIG. 4, a first rectangular cover 14 of the type used for limp book binding is glued to the edges 12 of the first book 2 adjacent the gutter 5. The cover 14 is divided into three portions along its length and comprises a rectangular top flap 15 which, in normal use, lies adjacent the top page of the book 2 but may be folded back away from the top page. Adjacent the top flap 15 is a rectangular binding strip 16, which is in contact with the glue applied to the edge 12 of the first book 2, thus the binding strip 16 forms the spine of the first book 2. On the side of the binding strip 16 opposite the top flap 15 is a rectangular lower flap 17. The lower flap 17, in normal use, lies adjacent the back page of the first book 2 but may be folded back away from the back page. Thus the cover 14 enfolds the pages of the first book 2.

Similarly, the second book 3 is enfolded by a second cover 18 which is substantially identical to the first rectangular cover 14 of the first book. The second cover 18 thus comprises a lower flap 19 adjacent the back page of the second book, which is adjacent a strip 20 that forms the spine of the second book 3, and which in turn is adjacent the upper flap 21 which, in normal u se, lies against the front page of the second book 3.

Figure 5:
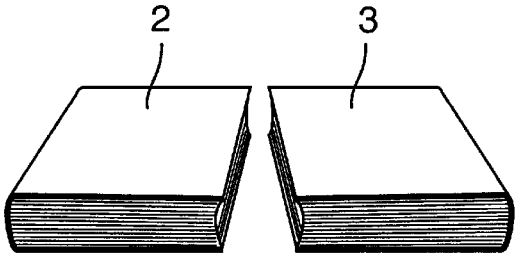
FIG. 5 is a perspective view of two books completed using the method embodying the present invention.

The margins 4, 8, 6, 10 and 7, 11 of the two books 2, 3 are then trimmed so that the covers 14, 18 lie flush with the edges of the pages of the books 2, 3. The finished books 2, 3 then appear as shown in FIG. 5. It is to be noted that in this method of binding books, the head and foot margins 6, 10, 4, 8 are trimmed at the same time and the trimming of the fore-edges 7, 11 is done sequentially.

Figure 6:
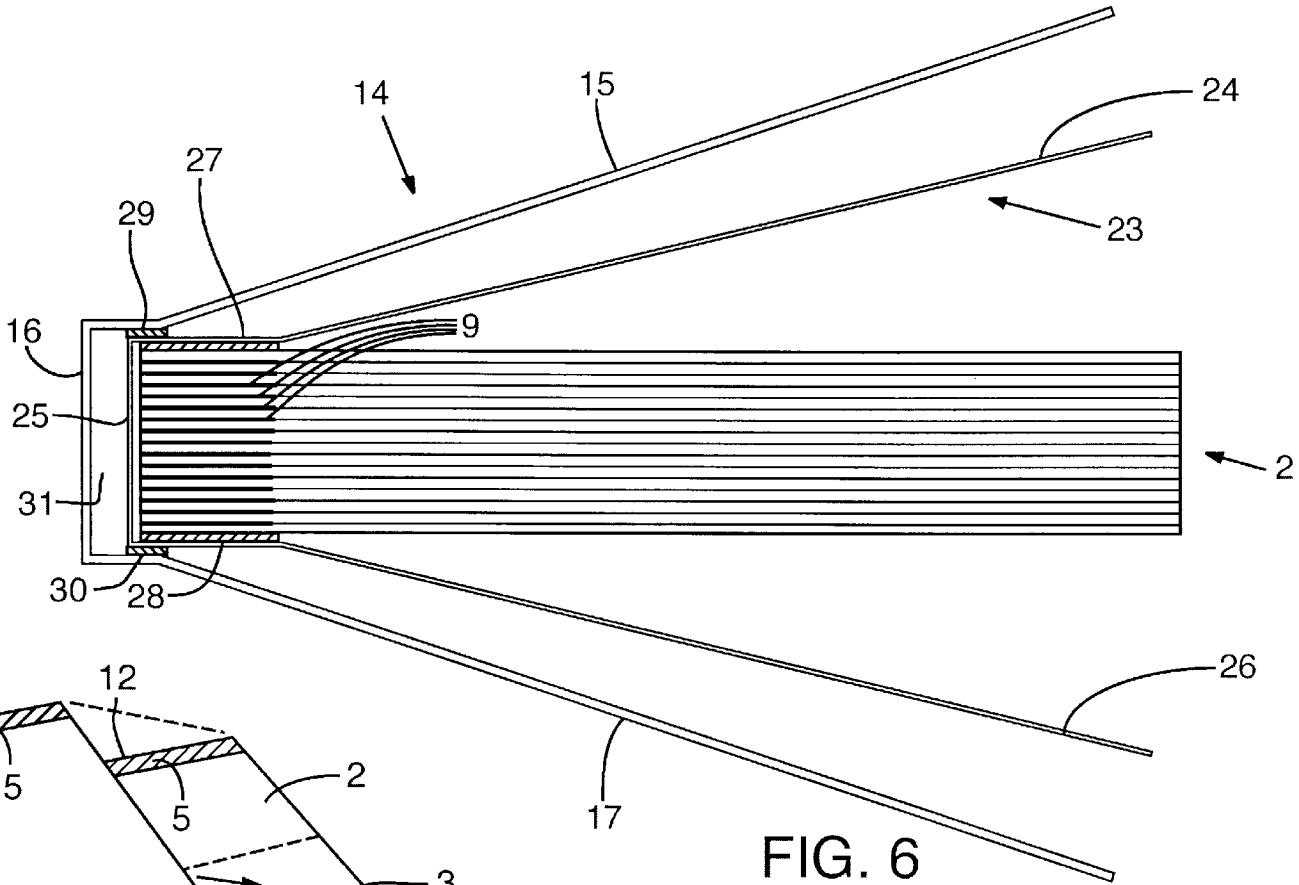
FIG. 6 is a side view of a book completed using another method embodying the present invention.

In a further embodiment of the invention the first cover 14 is not directly glued to the edges 12 of the pages of the first book 2, nor is the second cover 18 directly glued to the edges 13 of the pages of the second book 3. Instead, as shown in FIG. 6, a rectangular end paper 23 is provided between the pages of the first book 2 and the first cover 14. The end paper 23 is divided into three rectangular portions along its length: a top portion 24 which lies between the first page of the book 2 and the top cover 15; a thin strip 25 lying along the centre of the end paper 23; and a bottom portion 26, on the other side of the strip 25, the bottom portion 26 lying between the back page of the first book 2 and the lower flap 17. The inner side of the thin strip 25 of the end paper 23 is glued to the edges 12 of the pages of the first book 2 adjacent the gutter 5 as are longitudinal strips 27, 28 running adjacent the thin strip 25 and respective top and bottom portions 24, 26. Therefore, it is the end paper 23 which holds the pages of the first book 2 together. With regard to the cover 14, a portion of the outer side of the longitudinal strip 27 adjacent the thin strip 25 is glued to a smaller strip on the inner surface of the top flap 15 to form a first cover joining region 29. Similarly, a portion of the outer side of the longitudinal strip 28 of the end paper 23 adjacent the thin strip 25, is glued to a smaller strip on the inner surface of the lower flap 17 to form a second joining region 30. A hollow or space 31 is left between the binding strip 16 of the cover 14 and the thin strip 25 of the end paper 23. Thus, the first cover 14 enfolds the end paper 23 which, in turn, enfolds the pages of the first book 2.

It is to be noted that, in the book 2 shown in FIG. 6, because of the hollow 31, the binding strip 16 is not directly attached to the thin strip 25 of the end paper 23. Thus, when the book 2 is opened, the binding strip 16 is able to curve or move outwardly away from the thin strip 25 and the edges 12 of the first book 2. This method of construction reduces the likelihood of the spine of the book 2 from breaking when the pages of the first book 2 are opened into a reading position.

The bonding agent being used can be applied to the covers 14, 18 and then the covers 14, 18 attached to the end paper 23 or the text hull 1 or vice versa.

It is also to be understood that in further embodiments of the present invention, the pages of the first book 2 and the second book 3 may be held together and attached to their respective covers simultaneously with means other than glue. For example, the pages may be held together by thermo-binding, wire-binding, comb-binding, side stabbing, punching, slot (notch/burst) binding, thread sewing, binding rings, binding screws, binding prongs or slides.

It is to be appreciated that the above described methods are not limited to producing two books from a text hull but can be used to produce four, six, eight books and so on as long as the fore-edges of the books are located along the centre of the text hull.

The covers 14, 18 may be hard back covers instead of the limp book binding covers described above.

It should be noted that in connection with the embodiment shown in FIG. 6, the end paper 23 is not essential. The cover can be fixed directly to the text block.

In a preferred embodiment of the invention, the sheets of paper making up the text hull are already provided with the bonding agent along the gutters 5, 9 for binding the pages to one another before being printed/copied. For example, a wet glue which is only activated upon contact with water is provided in rectangular strips adjacent the gutter edge of the paper. The paper is printed and stacked into text hulls. The text hulls are secured and the gutter edges fanned and water sprayed on the gutter edges to activate the wet, glue. After fanning, the gutter edges stick to one another. Rather than fanning the text hull after it has been formed, it would also be possible to activate the wet glue by spraying the glue with water as the pages leave the printer/copier and descend to be stacked on the text hull.

Figure 7:
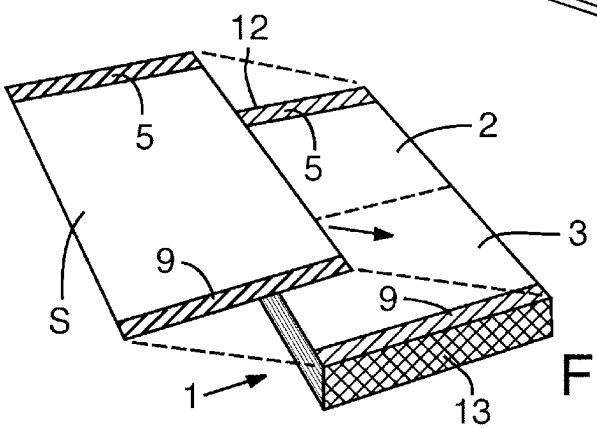
FIG. 7 illustrates a printed/copied sheet as the sheet moves onto the stack that forms a text hull.

In another variant, the bonding agent is a strip of self-adhesive provided with a release paper along each of the gutters 5, 9. The paper is printed/copied with the release paper covering the self-adhesive. As the paper is dispensed from the printer/copier, means are provided to strip the release paper before the paper descends onto a text hull. As the pages are stacked onto one another to form the text hull, the self-adhesive sticks adjacent pages together along the gutter edges so that the bonding is carried out as the text hull forms. See, for example, FIG. 7, which illustrates a printed/copied sheet "S," carrying on its gutters 5, 9 the bonding agent (such as the above-described self-adhesive or glue), as the sheet moves onto the stack that forms the text hull 1. Because the bonding agent is in place between the pages rather than at the very edges 12, 13 of the pages (as in traditional gluing methods) a much stronger bond is formed than has previously been possible when processing text hulls.

What is claimed is:

1. A method of binding books comprising the steps of:

forming a text hull, the text hull comprising the pages of two joined books, each page having a surface for text, the surface also defining marginal gutters, the gutters of said two books being located adjacent to opposite edges of the text hull, the forming step including bonding the gutters of each page of the text hull to one another as the text hull is formed by the stacking of the pages; and dividing the text hull to separate said two books from one another.

2. A method according to claim 1, wherein the bonding step comprises the step of applying adhesive.

3. A method according to claim 2, wherein the adhesive is a cold glue, a hot glue, a wet glue or a self-adhesive.

4. A method according to claim 1, wherein the means are provided to activate a bonding agent provided on or in the pages of the text hull as the text hull is formed.

5. A method according to claim 1, wherein the two books include fore-edge margins that are joined at the center of the text hull prior to the dividing step and wherein the step of dividing the books from one another comprises the step of trimming the fore-edge margins of said two books, the fore-edge trims separating said books from one another.

* * * * *